US006443796B1

(12) United States Patent
Shackelford

(10) Patent No.: US 6,443,796 B1
(45) Date of Patent: Sep. 3, 2002

(54) SMART BLOCKS

(76) Inventor: Judith Ann Shackelford, 615 N. Camden Dr., Beverly Hills, CA (US) 90210

( * ) Notice: Subject to any disclaimer, the term of this patent is extended or adjusted under 35 U.S.C. 154(b) by 0 days.

(21) Appl. No.: 09/596,634

(22) Filed: Jun. 19, 2000

(51) Int. Cl.[7] ..... A63H 17/00

(52) U.S. Cl. ..... 446/91; 446/118; 446/484; 446/485; 273/238; 273/237; 434/224

(58) Field of Search ..... 446/91, 90, 118, 446/477, 487, 485; 273/238, 237; 434/224

(56) References Cited

U.S. PATENT DOCUMENTS

| | | | | | |
|---|---|---|---|---|---|
| 3,484,984 | A | * | 12/1969 | Fischer | 446/91 |
| 3,696,548 | A | * | 10/1972 | Teller | 446/91 |
| 4,348,191 | A | * | 9/1982 | Lipsitz et al. | 434/308 |
| 4,552,541 | A | * | 11/1985 | Bolli | 446/91 |
| 4,556,393 | A | * | 12/1985 | Bolli | 446/91 |
| 4,743,202 | A | * | 5/1988 | Bach | 446/91 |
| 5,013,047 | A | * | 5/1991 | Schwab | 273/238 |
| 5,154,615 | A | * | 10/1992 | Joubert | 446/91 |
| 5,411,428 | A | * | 5/1995 | Orii et al. | 446/90 |
| 5,742,486 | A | * | 4/1998 | Yangkuai | 446/91 |
| 5,779,515 | A | * | 7/1998 | Chung | 446/91 |
| 5,788,553 | A | * | 8/1998 | Shivers et al. | 446/91 |
| 5,853,327 | A | * | 12/1998 | Gilboa | 273/237 |
| 5,906,369 | A | * | 5/1999 | Brennan et al. | 273/238 |
| 6,190,174 | B1 | * | 2/2001 | Lam | 273/237 |
| 6,206,745 | B1 | * | 3/2001 | Gabai et al. | 446/91 |
| 6,227,931 | B1 | * | 5/2001 | Shackelford et al. | 446/477 |

FOREIGN PATENT DOCUMENTS

| | | | | |
|---|---|---|---|---|
| GB | 2186731 A | * | 8/1987 | 446/91 |
| GB | 2188956 A | * | 10/1987 | 446/91 |

* cited by examiner

*Primary Examiner*—Derris H. Banks
*Assistant Examiner*—Urszula M. Cegielnik
(74) *Attorney, Agent, or Firm*—Ronald M. Goldman

(57) ABSTRACT

A child's construction set contains virtual intelligence, is interactive and smart, characteristics that may be exhibited to a player during player construction activity with the set and, thereafter, during continuing play and instills a sense of unpredictability to play. The set incorporates a programmed controller (17), a speaker (23), special ("smart") play pieces or blocks (1,3,5,7, et cet.) and a base (15) on which to position the play pieces or blocks. Sensors (A1–C3), referred to as "hot spots", are distributed at various positions about the base and are coupled to the controller, whereby the controller identifies special play pieces and the location of those play pieces when the respective play piece is installed at one of those positions. Some of the special play pieces may depict characters, some contain electrically operated devices, and some contain a player operated input device. The controller issues speech messages or other audible effects through the speaker to effect a virtual personality to the character play pieces; controls operation of electrically operated devices in special blocks, and detects and responds to player inputs from the player input blocks. Through wireless communication devices, the controller may acquire information from and supply speech messages to accessory blocks that are used off the base of the construction set.

36 Claims, 6 Drawing Sheets

42
44
J2
J4
8
J3
J1
10
7

24
29
26
28

1
64
63

1
C1

7
8
9
22

11
18
14

4
11
20
4
4

16
13
12

SMART BLOCKS

FIELD OF THE INVENTION

This invention relates to children's construction sets, and, more particularly, to an interactive construction and play set that exhibits a virtual intelligence and interacts with and/or responds to the player during construction and in continuing play.

BACKGROUND

Increasingly, children are computer literate at an early age, some as young as two or three years old. They are wise to the electronics of their environment, and, some may say, smarter than children of prior generations. They've been exposed to toys, playthings and other consumer goods that talk like a human and make sound effects. Yet electronics has produced far more than simply sound effects and human speech to computers, appliances, toys, cars, and other electronic products found in the environment. Through the use of microprocessors and/or microcomputers, controllers of those electronic products are given the ability to store programming logic, sound effects and speech. Those electronic products and devices appear to be smart, possess intelligence, and are able to interact and converse with the product users. Those products are made "artificially intelligent" and "virtually real"; and seem to "know" what the product users are doing or have done in the past.

Because children are products of the era into which they are born, they easily assimilate the technology that surrounds them from birth. Today's kids therefore expect to be able to interact with the objects in their environment, particularly with their playthings and toys. They are as comfortable with the computer as the telephone, and can learn to press the keys of a keyboard to create cause and effect and interaction with a display screen long before they even learn to write. As a consequence one finds that children become bored more quickly with conventional playthings than the children of prior generations. That change in interest is seen in the toy marketplace. Manufacturers of conventional toys appear to be losing business and market share to manufacturers of "smart" electronic toys, video games, computer CD-ROMS and other items that the children find more compelling.

Examples of this new era is the PETE TM program from Mindscape and Creatures™ program from Mindscape that electronically bring "virtual life" to computer creatures. The Creatures toy is described by the seller as even having "digital DNA" and artificial intelligence to elicit a child's interest. Electronics, including the programmed microprocessor, have brought the same kind of "virtual life" to stand-alone toys. The Tomagotchi™ virtual pet, the Manor™ pet, and the Gigabit Pets™ are handheld "virtual pets" that recently swept the consumer marketplace, creating a trend and consumer demand for interactive "virtual" smart toys that persists to the present.

A more recent example of stand-alone smart toys are the "Amazing Amy™" and "Amazing Ally™" dolls marketed in the U.S. by the Playmates Toys Inc. Those dolls contain microprocessors that are programmed to give the dolls a virtual intelligence. The Amazing Amy doll is able to detect the type and kind of play food or appliance (eg. simulated items supplied with the doll) placed in the mouth of the doll, to voice requests for certain foods, to voice objection if fed a food that differs from the food requested, plays games with the child and voice many other statements, allowing the doll in many respects to simulate a living child. The Amazing Ally also simulates a living child and interacts with the child. Children find the experience with such dolls exciting and real; and those toys have in fact recaptured the interest of older girls who have become bored with conventional dolls (sic non-virtually smart) offered by other toy manufacturers.

The practical effect of the foregoing is that today's children expect to also interact with toys that also appear to be "smart." Lacking "smart" toys, children quickly turn to computer and video games, music, and high tech electronic gadgets for entertainment or instead are spending their money on clothing and accessories, music, movies, and fast food.

The shift in interest has not gone unnoticed by toy manufacturers, who to avoid becoming obsolete, are seeking ways to rekindle a child's interest in the manufacturer's toys. One such example is in construction sets, such as building blocks. Those construction sets typically contain plastic blocks that the child may attach to one another and to a base to build various figures and structures, effectively creating a setting. The blocks (and base) frictionally attach to one another by means of coupling grips (as may be formed of sockets, bars or the like) wherein the coupling grips, located on the under side of a block, engage with coupling pins or studs arranged evenly and in parallel rows and columns on the top side of another block (and/or on the base). Until the present, construction sets of the foregoing type have long served and continue to serve to interest those children inclined to enjoy building things.

Those construction sets presently offer only two dimensions of play: The primary play is construction, in which the child constructs a building, vehicle, or other structure from scratch by assembling together a kit of pieces and parts. The secondary play is to use the thing that was constructed for play. The child uses its imagination to create adventures inspired by the theme associated with the construction set (sic the structure which can be built from the blocks or play pieces intended by the theme).

Attempting to make construction sets more compelling, a leading manufacturer, the LEGO Group, which markets under the LEGO® brand name, has been adding attractive brands and copyrighted characters familiar to children to the product and the theme of the product. That company has also included some simple electronics in their stand-along products such as a flashing light and a siren sound in a preschool construction set of a fire truck or rescue vehicle in theme. Further, that company also introduced a complex robotic system that requires a computer interface. Older children and adults must first build complex robotic products and then create a computer program on their personal computer ("PC") to control the constructed robotic product. That computer program is then downloaded into a "brain" that controls the movement within the robotic device. As evident from the patent literature, the Lego Group "electrified" construction blocks, perhaps as part of the foregoing effort, to integrate electrical paths through the individual blocks in order to route electricity, such as by attaching a conductors on the studs of a block (and employing coupling sockets containing electrical conductors). It thus appears generally known to provide electrically operated elements within the construction block set as demonstrates the engineering feasibility of allowing the child to mimic an electrical construction project.

What foregoing feats of engineering appears to lack is the "magic" of any "virtual" or "smart" interaction between the product being constructed and any characters that are supplied in the constructed product and the player-builder. Although the child may learn to follow directions and achieve satisfaction in the building of a structure, and may use imagination to create settings, scenes in which to play with the structure that one has built, that alone does not pique a child's imagination in the same way as occurs with the Amazing Amy doll, earlier mentioned. Instead the child is in full control of the play scene and the events that are to occur.

The construction set cannot "talk back" or take any action. The set possesses no seeming initiative of the kind found in other electronic toys and in application programs of general or special purpose computers (video games). The child is not faced with the excitement and challenge of dealing with the unexpected. As an advantage, the present invention offers an interactive arrangement for the child, allows the construction set to appear to be virtually alive and to be artificially intelligent and speak, and affords play that offers a greater challenge, is more compelling and basically provides more fun for the child.

Accordingly, an object of the present invention is to enhance interest in and excitement in play of children's construction sets by bringing the construction set into the "virtual" and "smart" electronic age.

An additional object of the invention is to imbue a child's construction set with features that confront the child with a sense of unpredictability to events occurring in fantasy play and challenge the child.

A further object of the invention is to remove full control of the events of play in a child's construction set from the player and place some of that control within the construction set.

A still additional object of the invention is to provide a play environment for a child's construction set that incorporates characters and other play figures with a virtual intelligence.

A further object of the invention is to permit a construction set to provide speech messages, statements and/or sound effects and/or visual cues to the player both during construction and during play with the constructed structures.

And an ancillary object of the invention is to permit the child to simulate the remote control of another play piece or play pieces mounted in the construction set using another one of the play pieces mounted in the construction set as a simple remote controller.

SUMMARY OF THE INVENTION

In accordance with the foregoing advantages and objects, the invention is realized in any standard child's construction set by incorporating therewith a programmed controller, a speaker and special ("smart") play pieces. The smart play pieces contain controller readable identification indicium. The controller is able to access and read that indicium to identify the play pieces and is able to determine the location of each such play piece installed on the base of the construction set. With such knowledge, the controller may retrieve from memory and issue, exhibit, speech messages or other audible effects through the speaker. Some play pieces comprise character figures, and the speech messages and/or audible effects exhibited are able to create a virtual being of such figures.

In accordance with a further aspect to the invention, some of such smart play pieces also incorporate peripheral devices, electrically actuated devices which the controller is able to actuate in accordance with action prescribed in the controller program, either at the initiative of the program and/or in response to detection of an action occurring at a separate play piece, such as a player input. In a more specific aspect, the controller operates an electrical device, such as lamp or a motor, contained in one play piece when the player supplies an input in another play piece, such as operating a switch.

The controller provides a virtual intelligence and interaction between the child and the playset and its characters. The memory of the controller contains many words and/or phrases of speech and sound effects related to specific play pieces and characters which may be communicated to the player; and, of those, a plurality of speech phrases and sound effects unique to specific play pieces and characters, depending on the play situation or mode of play for the construction set. The controller may select from a variety of stored messages, and various logic branches of pre-programmed play patterns, adventures, stories, or games, adding a sense of unpredictability to the play patterns and avoiding the repetition that dulls interest in a toy. Games may incorporate invisible alien beings or forces whose presence is felt by the player through the sounds generated and/or animated graphics presented on a display, and involve the player in defending against those inherently evil beings and forces.

The controller also allows activities, initiated by the players placement of characters or smart play pieces at certain locations on the base of the construction set or the players operation of various types of switches, all of which cause interactive responses by the construction set and the characters positioned therein, or, in accordance with an additional aspect to the invention, by remotely positioned construction sets and any characters therein.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Figures 1, 3:
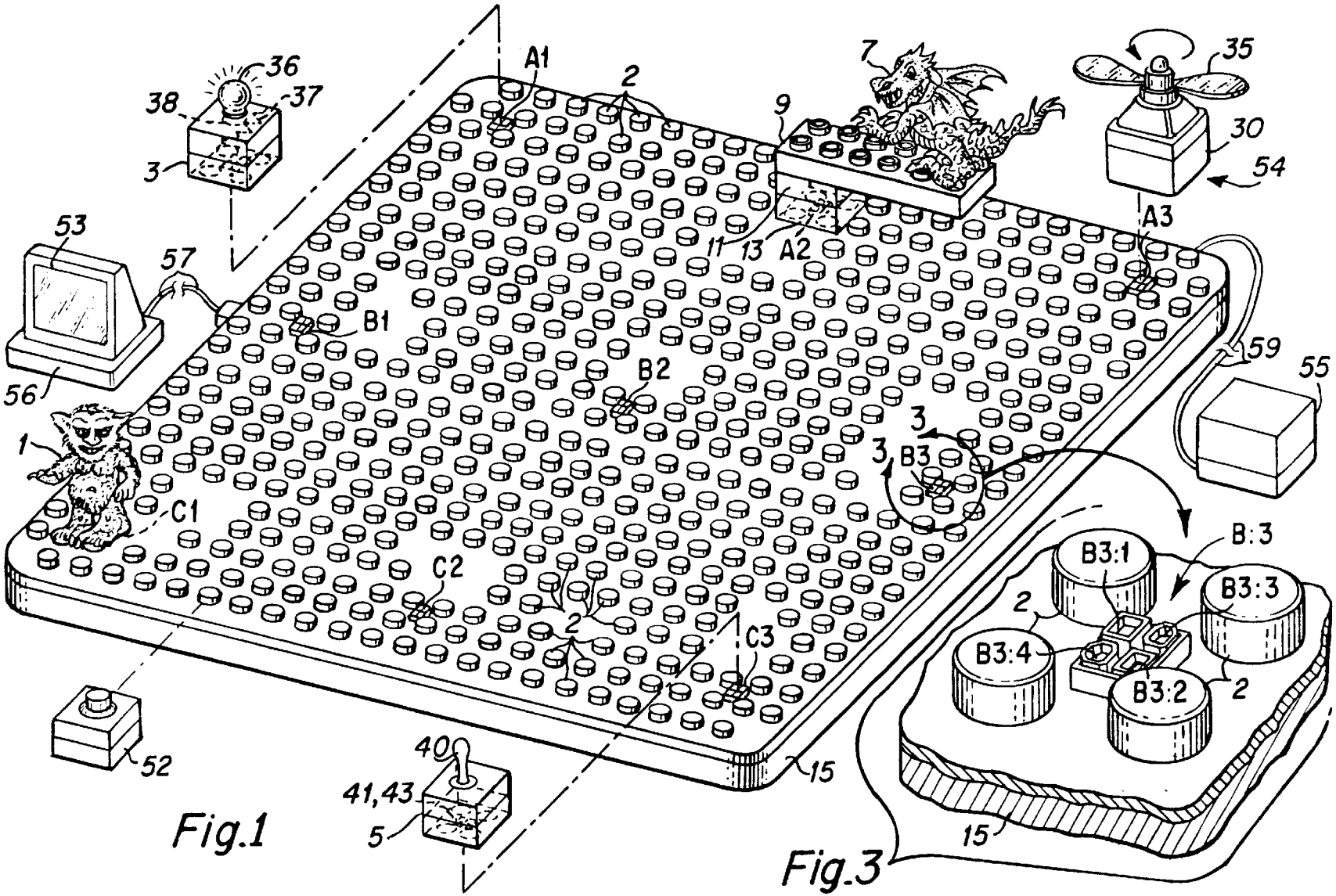
FIG. 1 illustrates an embodiment of the invention defining a construction set, including its associated play pieces and base.
FIG. 3 is an enlarged view of a portion of the base of the embodiment of FIG. 1 containing one of the electrical connectors supported in the base that defines a "hot spot"

The preferred embodiment of the play construction set illustrated in FIG. 1 contains a number of play pieces 1, 3, 5, 7, 9, 11, 13, 52, 53, 54 and 55, sometimes referred to herein as "blocks", and a base 15, suitably formed of plastic, onto which the foregoing (and additional) play pieces may be coupled or mounted, typically using a frictional attachment. Each of the play pieces illustrated may be positioned at any location on the base in accordance with the wishes of the player. Additional play pieces, not illustrated in the figure, may be included for installation on the base and/or for use in play off that base.

Play pieces 5 and 52 contain electrical switches that the player may operate to produce player inputs, essentially forming switch blocks. Play pieces 3, 53, 54 and 55 contain peripheral devices that are electrically actuated. The peripheral device in block 3 is a lamp; that in block 54 is a motor driven propeller; that in block 53 an LCD display; and that in block 55 an infra-red (IR) transmitter. Play pieces 1 and 7 are fantasy figures, respectively "troll" and "dragon" characters. Because each of the foregoing play pieces contains a computer readable identification, later herein described in greater detail, those blocks are sometimes referred to herein as "smart" blocks. Play pieces or play pieces 9, 11, and 13, however, do not contain such identification and, hence, are not included herein in the "smart" category. Though appearing as ordinary blocks, they include electrical conductors as later herein described.

Preferably base 15 also defines within the depth dimension a container or housing for storage of additional components of the embodiment, miniature in size, so that those components are hidden from view. An electronic controller 17, illustrated in FIG. 2, suitably includes a programmed microprocessor or computer, as variously termed, memory and other associated elements, and the power supply and cabling, is housed inside that formed container. As later herein described in greater detail, the controller, among other functions, receives identification information from and identifies certain of the play pieces that are installed at certain locations on the base, called "hot spots", and identifies the location of the respective play piece identified; identifies and responds to player inputs and reacts to those inputs as may include actuating another of the smart blocks that contains an electrical device and/or delivering a speech message or sound effect.

Reference is again made to FIG. 1. To mount the play pieces to base 15, an evenly distributed plurality of short upright cylindrical studs 2, are arranged in rows and columns on the base. Those studs serve as coupling pins to frictionally engage the play piece from the underside and mount the play piece to the base at the location selected by the player. The underside of the play pieces contain frictional grips, couplings, that grips the respective studs. Those couplings are not visible in this figure due to the obstruction presented by sides of the respective play pieces, which are illustrated, for one, in FIG. 6B.

Figures 4A, 4B, 5A, 5B, 6A, 6B, 7, 8A, 8B:
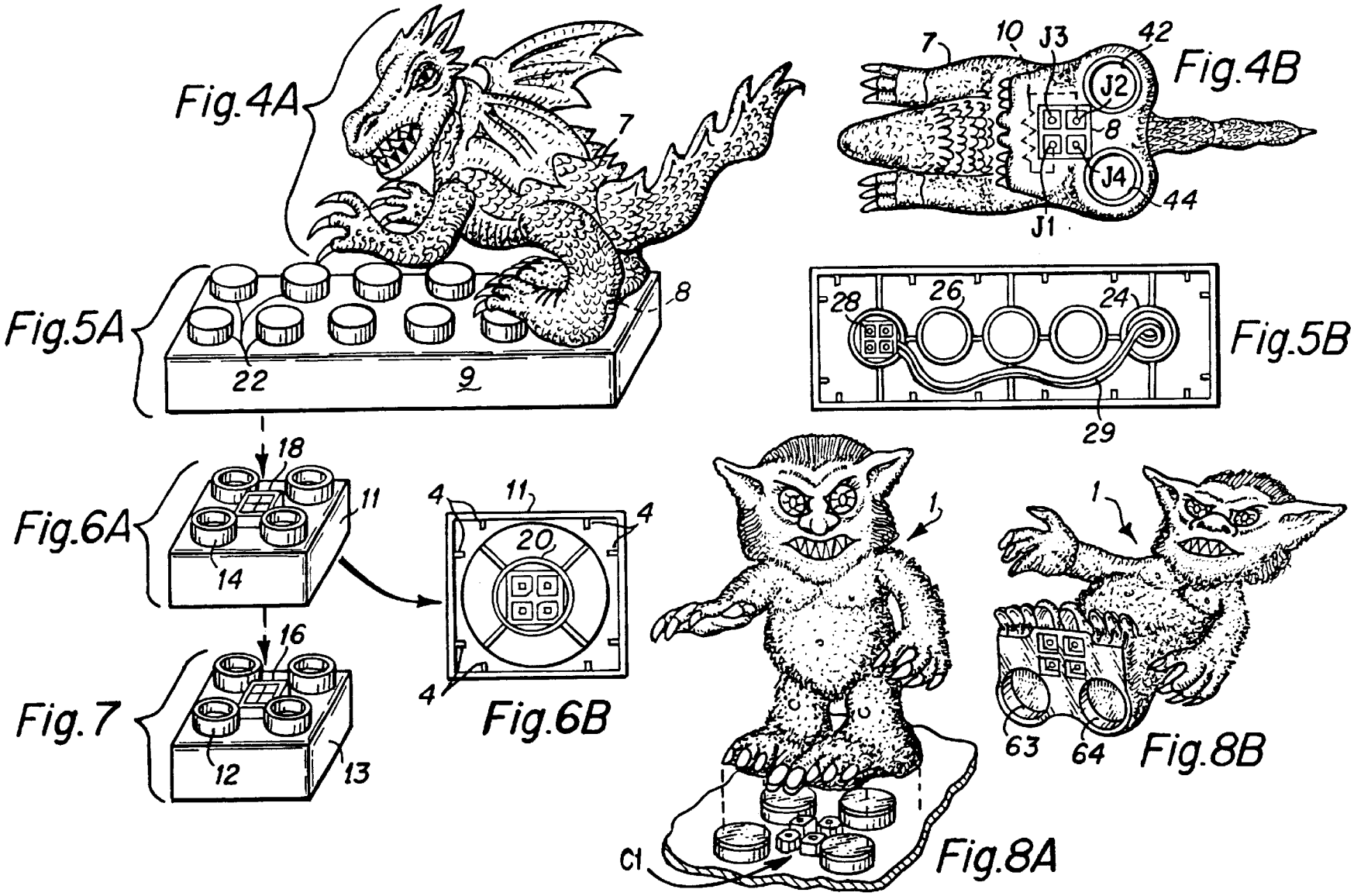
FIGS. 4A and 4B illustrate the dragon figure play piece used in the embodiment of FIG. 1 in perspective and bottom view, respectively.
FIGS. 5A and 5B illustrate in perspective and bottom views, respectively, a long connector extension block used in the embodiment of FIG. 1 to elevate the "hot spot" connection vertically and/or position that "hot spot" as many as three small block widths from the underlying position in the base of the construction set.
FIGS. 6A and 6B illustrate in perspective and bottom views, respectively, a small size connector extension block used in the embodiment of FIG. 1 to elevate the "hot spot" connection vertically one block height from the underlying position on the set base (or another extension block)
FIG. 7 illustrates another small size block used in the embodiment of FIG. 1, identical to that of FIG. 6A, to illustrate forming a stack the extension blocks.
FIGS. 8A and 8B illustrate a troll figure play piece in a perspective and prone positions.

The grips included on the underside of a play piece are illustrated, for one, in FIG. 6B to which brief reference is made. The bottom view of play piece 11 illustrated, one of the stacked blocks in the rear of FIG. 1, includes inwardly directed spaced ribs 4 extending vertically up the side walls of the rectangular shaped play piece. The relative geometry and dimension of the thin outside edge of the ribs produces a friction fit to the cylindrical walls of studs 2 of the base, the latter of which are represented by dotted lines. Because both the ribs and the studs are constructed of plastic material, which possesses some flexibility, the bottom of the play piece slides into place over the studs and is held in place.

By aligning a play piece, such as the troll figure play piece 1, with a pair of rows and along a column (or with a pair of columns and along a row) and pressing the play piece down onto the base, the grips on the underside of the play piece slide alongside and frictionally engage the cylindrical walls of the studs, four of the studs (2×2) for the smallest size block, and the play piece is thereby frictionally held in place on the base. The play pieces are easily removed from that position on the base, by pulling the play piece upward, overcoming the frictional connection to the studs.

With like mechanical couplings, other play pieces that contain grips on the underside may also be attached on top of other play pieces that contain coupling studs on the upper surface. As an example, smart play piece 7, decorated as a dragon character, is mounted atop a stack of blocks 9, 11, and 13; and the bottom most block 13 is mounted to the base. Those skilled in the art will recognize the general construction of the play piece to base and play piece to play piece mounting structure, which is known, is found in the plastic blocks in the Interlego (LEGO) and Duplo brand construction sets. Each of the play pieces contains like grips on the underside enabling the play piece to mount to the base (and to other blocks).

Continuing with FIG. 1, base 15 also contains a number of electrical connectors, A1 through A3, B1 through B3 and C1 through C3, that are exposed through openings in the upper surface of the base. Two of those electrical connectors are obstructed from view by play pieces 1 and 13. The foregoing connectors are identical in structure. Each connector is centrally located within a 2×2 array of studs 2, The connectors are distributed about the base, suitably evenly symmetrically positioned amongst the various rows and columns. For convenience, the locations of those connectors are sometimes referred to herein as "hot spots". In this embodiment the connectors are arranged in a 3×3 size matrix on base 15. As later herein described, the controller 17 is able to identify each of play pieces 1, 3, 5 and 7 and the respective connector, A1–A3, B1–B3, and/or C1–C3, the hot spots on the base to which the respective play piece is connected, and thereby determines the identity and location of such play pieces.

As shown in the enlarged partial view of FIG. 3, the electrical connectors in base 15 are female metal electrical connectors (sockets), each of which is housed inside a plastic sheath that forms a male plastic housing connector. Therefore, each "hot spot" consists of a square cluster of four male sheaths housing four metal female sockets. Preferably, the connector is keyed (or contains a keyed surface), which requires the mating male connector or plug (such as that on the smart block, later herein described) to be correctly angularly oriented in order to mate with the female connector. In this embodiment the outer surface of the insulator portions of the respective connector contacts, the plastic sheath, is of a distinct shape that provides such keying, and permits the connectors to mate only if the female keyed protective insulator holes surrounding the male connectors are oriented at zero or 180 degrees. Contacts B3:1 and B3:2 are used in one input circuit to the controller, and contacts B3:3 and B3:4 are used in an output circuit from that controller, as later herein discussed in greater detail.

Figure 2:
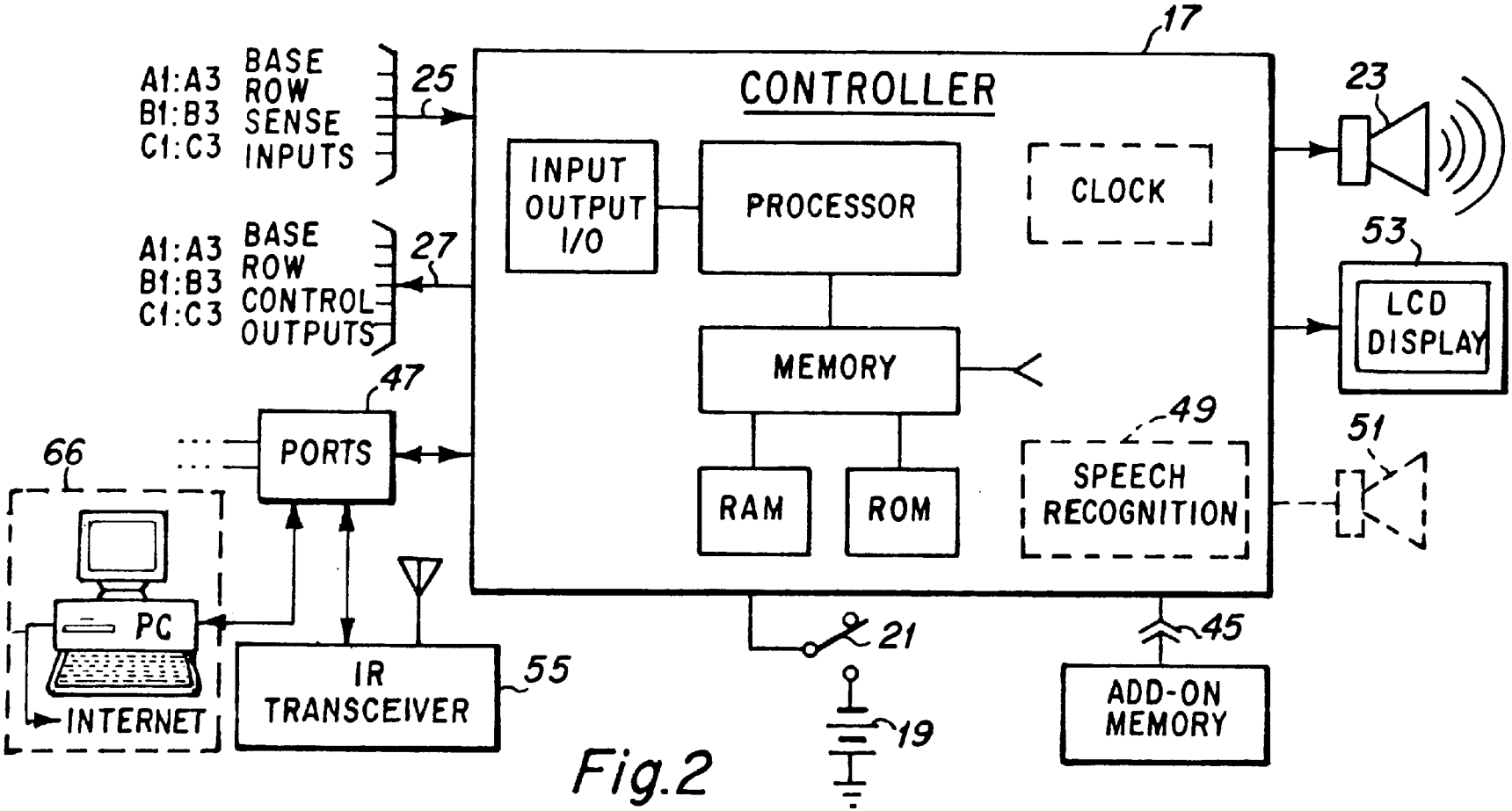
FIG. 2 is a block diagram of the controller for the embodiment of FIG. 1.

Reference is made to the block diagram of electronic controller 17 and the associated components in FIG. 2. Electronic controller 17, typically, is a programmed digital microcontroller or, as variously termed, microcomputer, containing semiconductor memory and operating programs. Preferably, the controller is in the form of an integrated circuit (IC) chip, which is thought to be the least expensive approach for toy product, or, may comprise a group of such IC chips, all of which are known. The controller contains appropriate input and output devices and control circuits and is powered by batteries. The foregoing also includes a speech synthesizer, either defined in by software or as separate semiconductor chips, including a digital-to-analog converter, and appropriate multiplexers and other input and output interface circuits, including various ports for communicating with other devices, such as a serial port or USB port and the like, and audio and display output. Operation of the controller is controlled by software, that is, computer programs, with the specific programs, both operating system program and application program, and data being stored in ROM. Some externally supplied data and program material as may be used by the controller, described later herein, is stored in non-volatile memory, EPROM, that may be "plugged" into the controller or in a Flashcard with data downloaded from a PC or web-site of the Internet. The controller is programmed to perform the various tasks and functions such as further described herein.

As generally illustrated in block form the controller may include a programmed microprocessor and associated memory, including read-only memory ("ROM") and random access memory ("RAM"). A battery 19, connected to the microprocessor through an "on-off" switch 21, supplies the DC operating power. A speaker 23 is driven by a speaker (audio) output to the controller to reproduce audio, such as speech and/or sound effects) in accordance with the requirements of the programming in the microprocessor. The microprocessor includes a number of inputs for receiving information and a number of outputs to provide control currents from and to certain of the smart blocks play pieces that are mounted to certain locations on base 15 (FIG. 1), the distribution of which is illustrated and described in greater detail herein.

A set of sense inputs, A1:A3 and the like that are connected to various hot spots on the base 15, are individually connected via cable 25 to the inputs of controller 17. A like number of control outputs of the controller are connected via cable 27 to the control leads A1:A3 of the base. A more explicit illustration of the latter is presented in FIG. 13, later herein discussed. The controller performs certain sense and/or control operations through the foregoing sense and control inputs and outputs. Separately from the sense inputs, wireless transceiver 55, one of the smart blocks, is connected to the controller through one of the communication ports 47, preferably a serial port. The inputs for driving LCD display 53, another smart block, is supplied through a display output of the controller via cable 59.

The program of the controller includes the routines for frequently checking the various sense inputs on the base, for specifying a particular script of activity, whether defining a game or construction activity, and for providing control outputs to the outputs on the base. The program also includes a database or library of speech messages and sound effects, and a variety of image or image generating subroutines. Other portions of the program, such as a scripted activity, determine when a particular speech message or sound effect is selected and the context or time when that speech message or sound effect is to be delivered to the player and/or an image is to be presented. By outputting the contents of various locations in the voice ROM, and applying that digital information to the digital-to-analog converter, serving as a speech synthesizer, and thence to speaker 23, the speech messages and/or sound effects are related to the player. The verbal messages and sounds are preferably human voices that are recorded as digital information and stored in a portion of the ROM memory using any standard technique. Preferably, the library of speech messages is sufficient in extent as to enable the controller to define a "virtual personality" for the various character figures, such as the troll and dragon figures, and/or any other block.

Preferably, the microprocessor of the controller should be powerful and fast enough to proceed through the program and have the voices and character conversation appear natural. In alternative embodiments, the controller may incorporate separate audio display controllers to handle generation of speech messages, freeing the main controller for other necessary activities. Display controllers, typically contain a separate microprocessor, are commonly found in personal computers where the device serves video displays.

Other functional units as may be included in the controller include a clock-calendar 50, speech recognition 49 (and the associated microphone 51) which are illustrated in dash lines. To permit addition of other application programs, such as additional games and/or speech messages and sound effects, the controller preferably includes a memory port 45, to permit additional programs (in ROM) to be included. This additional memory may be a ROM chip which is embedded in a card and contains the additional program information or it may be in the form of a "flashcard" EPROM in which a program specifically designed for the construction set may be downloaded from a web-site over the internet, as example, by means of a personal computer 66, such as pictorially illustrated in FIG. 2 in a dash-line box as the PC, (or other processor controlled internet access apparatus), and then downloaded from the PC (or other internet access apparatus) into the flashcard. As example, a web-site may be maintained by the manufacturer to provide distribution of new game programs or other updates to the controller of the playset to those owners who access and desire to download that information. The manufacturer may even provide a place on the web-site through which different playset owners may upload programs which may be downloaded by other playset owners. In the foregoing way the construction set never stales. The program of the controller should be enabled to test for presence of these additional devices. These options are discussed in greater detail later in this specification.

The program for the additional forms of play desired in the construction set, for identifying certain of the play pieces and their location on the base, a library of speech messages and sound effects and the means to convert digital speech messages and sound effects from the digital form in which stored to the analog form required for reproduction by the speaker 23 is stored in the ROM. The foregoing microprocessor control and programming is recognized as a familiar structure of and software to many electronic toys marketed in the past.

Figure 13:
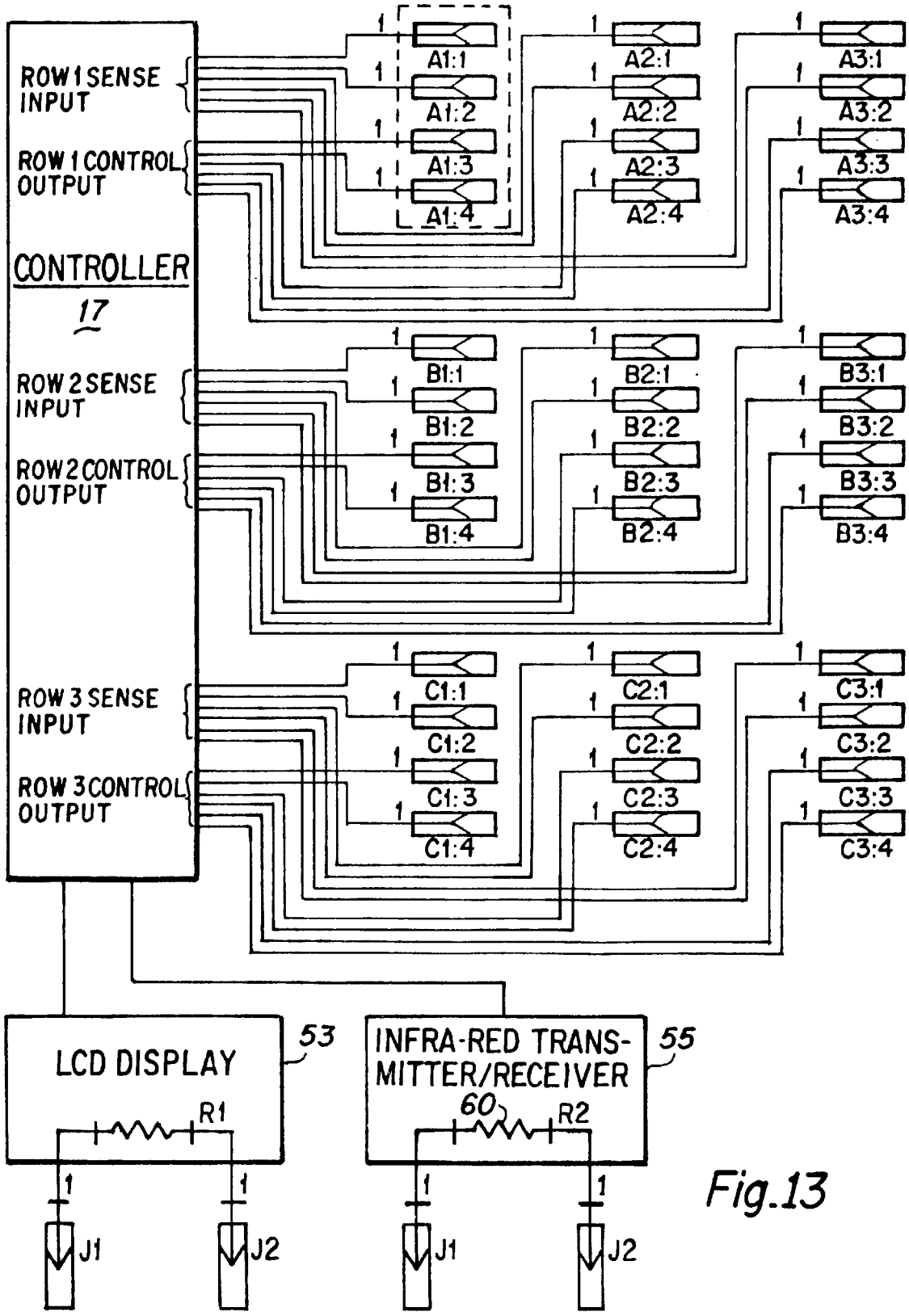
FIG. 13 is a wiring diagram for the cabling between the controller and the array of base connectors used in the embodiment of FIG. 1.

Reference is made to FIG. 13, which illustrates in greater detail the electrical network, the cabling, that underlies the upper surface of base 15. The cabling extends between nine connectors A1–A3, B1–B3 and C1–C3 of base 15 and the respective inputs and outputs of controller 17. The controller includes an input and output for at least the nine connectors included on base 15, and each of those inputs and outputs requires two leads. Each of the base connectors each contain four contacts, sub-numbered 1 to 4 for each connector, such as connector C3 in the lower right corner of the figure. Two of those connector contacts, C3:1 and C3:2, are electrically connected a respective sense input of the controller and the remaining two contacts C3:3 and C3:4 of that connector are electrically connected by the cabling to a respective output of the controller. As illustrated the foregoing connection protocol is used for each of the base connectors. Hence, any play piece, regardless of its particular characteristic, may be connected to any of the base connectors; and any identification resistor of the play piece will be sensed by the controller, and, depending upon the type of play piece, the controller is able to supply an actuation or control current to any active electrical component contained within the play piece.

Each of the multiple inputs (and outputs) of the controller is associated with a respective one of the base connectors by electrical leads. By that "hard-wired" technique, the controller is able to implicitly determine the location (amongst the nine separate locations on which the base connectors are located) of a particular play piece that is "plugged" into one of the base connectors. Alternatively, in other more complex embodiments the inputs of the controller may be matrixed or multiplexed to permit use of a greater number of base connectors than the number of input ports. By either the "hard-wired" or matrix technique, the controller is able to implicitly determine the location (amongst the nine separate locations on which the base connectors are located) of a particular play piece that is "plugged" into one of the base connectors. By periodically checking each base connector the controller is able to determine if a play piece is plugged into a particular base connector (sic is located at a particular "hot spot"), and if so, sense the value of resistance, and, hence, determine the identification of the particular play piece at that location. In accordance with that determination, the controller is able to take other appropriate action in accordance with the prescription of its stored program, such as outputting a control current over the control current leads associated with the particular play piece or those control current leads of a different base connector at which another play piece is plugged in.

As an example, if lamp block 3 and switch block 52 are installed on the base, the controller will have that information and the location of those blocks. By sensing operation of the switch a first time, the controller may be programmed to respond by supplying current to the control current circuit of the base connector to which the lamp block is connected, wherein the LED lamp is lighted; and, when sensing the next operation of that switch, removes the current and extinguishes the lamp.

Controller 17 maintains a library or, as variously termed, database that correlates resistance values and/or the resistor-capacitor ("R-C") network discharge times against the respective smart block assigned by the programmer to respective ones of those values. The foregoing library of identification information contains the information for any smart blocks supplied with the set, but, also that information for any additional "accessory" smart blocks contemplated by the toy manufacturer for separate purchase and use within the construction set. By consulting its internal library of that data, the controller knows which smart block is assigned the ohm value or R-C discharge time that was measured, thereby identifying the smart block to the program of the controller. The foregoing resistor identification technique described herein as the preferred technique to identify individual electrical smart blocks of the construction set is the same technique found in the Amazing Amy™ doll marketed by Playmates Toys, Inc. to identify various accessory food items placed in the mouth of the doll, and permitted the control unit inside the doll to identify the item.

Figure 11:
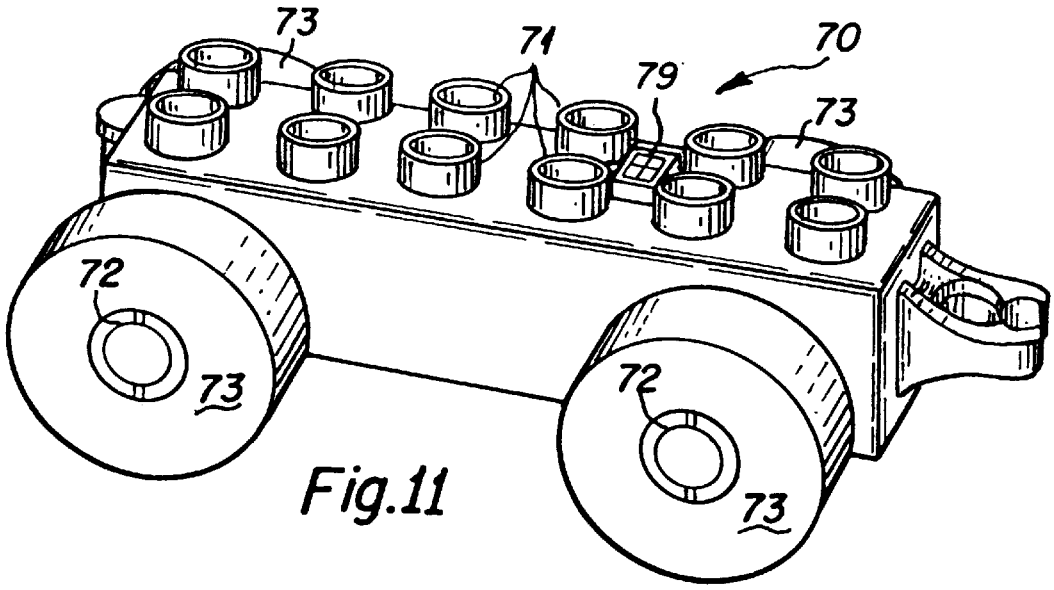
FIGS. 11 and 12 illustrate a radio controlled vehicle play piece that may be used for play with the embodiment of FIG. 1.

Since the sensors are not moveable, the program applicable to a respective sensor is authored with the respective sensors location on the base kept in the authors mind. Hence, the program has the knowledge of the sensor location essentially built-in. Alternatively, another of the controller's databases may contain a correlation between the sensors and their respective locations in the base. With either approach, the controller knows the location of each sensor. In those alternative embodiments containing accessories that may be used off of the base of the construction set, such as later described in connection with the vehicle of FIGS. 11 and 12 and wireless communication provided by transceiver 55, the identification information of the accessory and any smart block installed in the accessory is acquired by controller 17 in a different manner, later herein discussed.

Returning to FIG. 1, each of smart play pieces 1, 3, 5, 7, 52, 53, 54 and 55 and interconnecting blocks 9, 11 and 13 include a mating electrical connector on the underside, earlier illustrated in FIG. 4B that mates with the electrical connectors in base 15. When one of those smart play pieces is fitted onto a group of the four studs 2 that bound a centrally located one of the hot spots (in the 3×3 matrix), female connectors A1–A3, B1–B3 and C1–C3, the male metal connector (plug) of the smart play piece mates with the female metal connector (socket) in the base, extending four electrical paths between the base and the respective play piece.

As will be understood from the description of operation presented later herein, the invention encompasses a construction set having a base the contains up to a sufficient number of "hot spots" to cover every conceivable location on the base, not simply the 3×3 hot spot matrix employed in the practical embodiment being described. One realizes that the greater the number of hot spots, the greater is the manufacturing cost of the construction set, and that some compromise must be made for the preferred embodiment, if only to prevent an unacceptable cost. It is thought that the nine hot spots chosen in the illustrated embodiment of the invention represents an appropriate compromise between versatility and cost.

The individual play pieces may be considered in further detail commencing with the Dragon and Troll figures. Reference is made to FIGS. 4A and 4B, which illustrate a perspective and bottom view, respectively, of the dragon FIG. 7. In FIG. 1 that play piece was shown standing atop a stack of three play pieces, referred to as interconnection blocks, 9, 11 and 13. As shown in FIG. 4B, the underside of the dragon figure contains two stud couplers 42 and 44 to couple to studs 22 on block 9 (or on the studs of any other block or the base) while the front end of the rear feet are shaped to contact the top of the two studs of an adjacent row of studs and provide additional balance maintaining the figure upright.

Figure 10A:
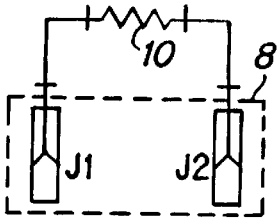
FIGS. 10A–10G are wiring diagrams for the various smart play pieces, switches and extension blocks used in the embodiment of FIG. 1.

The Dragon figure also includes a male electrical connector 8 that contains four contacts, also arranged in a square. An electrical resistor 10, represented in dotted lines, is contained within the dragon figure, suitably molded therewith, and is electrically connected serially between two contacts J1 and J2 of the connector 8. The remaining two contacts of that connector J3 and J4 are left unused. A wiring diagram for the dragon figure is illustrated in FIG. 10A, which requires no additional description. The resistor is of a particular resistance value assigned to the play piece by the designer. That value is different from the value of the resistor in any other smart block and identifies the play piece.

The troll FIG. 1 as illustrated in FIGS. 8A and 8B, like the dragon figure, also contains two stud couplers 63 and 64 and shaped feet that enable the figure to couple to another block or base (as in FIG. 1) and stand (or balance) upright in position; and contains the cluster of four male electrical connectors. As illustrated in FIG. 8A, those male connectors mate with the sheathed female connectors at a hot spot on the base, such as the four female connectors C1. Other character figures as might be included in a particular model of construction set may be constructed similarly to the troll and dragon figures. However, if the character figure has four legs or is in a prone position, then the base portion of the figure may include more stud couplers than the two used in the foregoing figures. The Interconnection Blocks. Blocks 9, 11 and 13 form electrically interconnecting play pieces. That is, the play pieces contain the connectors and internal cabling to provide electrical paths between base 15 and the dragon figure play piece 7. Such blocks are passive elements and, thus, do not need or contain an identification resistor. The structure of those blocks is better illustrated in greater detail in FIGS. 5A, 5B, 6A, 6B and 7 to which reference is made.

Blocks 13 and 11 are 1×1 size blocks whose upper surface contains four studs 12 and 14, respectively, which are of the same spacing and outer diameter as studs 2 in the base, and a female connector 16 and 18, respectively. As shown in FIG. 6B, the underside of block 11 contains the pin grips 4 and a centrally located male connector 20. Internal cabling, not visible in FIG. 6B, electrically connects the contacts in the male connector with the corresponding contacts in the female member of the block. The same structure is included in the like constructed block 13. Block 13 mounts to base 15 and block 11 mounts atop block 13, connecting through the electrical circuits through the connector in base 15.

Figure 10B:
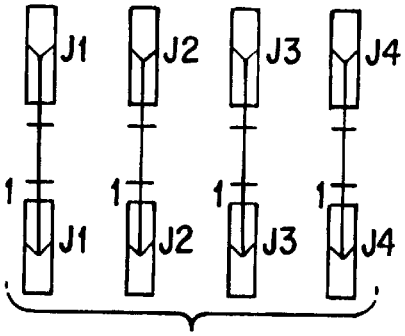

Block 9 is a larger 1×4 size block. The upper surface of block 9 contains eight studs 22 and a female connector 24 located to the right end. The underside of that block, as viewed in FIG. 5B, contains the appropriate stud grips 26 and male connector 28 located to the left end of the block. Electrical cabling 29 within the cavity defined in the underside of the block by the side walls extends electrical paths from the four contacts of the female connector to the four corresponding contacts of the male connector 28. The wiring diagram for each of the interconnection blocks is illustrated in FIG. 10B.

The electrical circuits from base 15 extend to the upper side of block 13 and further extend to the underside of block 9. By mounting block 9 atop block 11, the electrical circuit extend to the upper side of block 9. When seated in place on the pedestal formed by interconnecting blocks 9, 11, and 13, connector 8 of the dragon figure, mounted atop block 9, mates with connector 24 of block 9, thus placing the resistor 10 in an electrical circuit that extends through to electrical circuits through the connector within base 15. With the interconnecting blocks, the connector within base 15 is effectively repositioned both vertically and horizontally.

It is recognized that other character figures may be included in the construction set in addition to the dragon figure and the troll figure. Those additional figures would contain an identification resistor unique to the character and a unique shape and decoration defining the character, but otherwise, is constructed and wired the same as dragon play piece 7.

Figure 9:
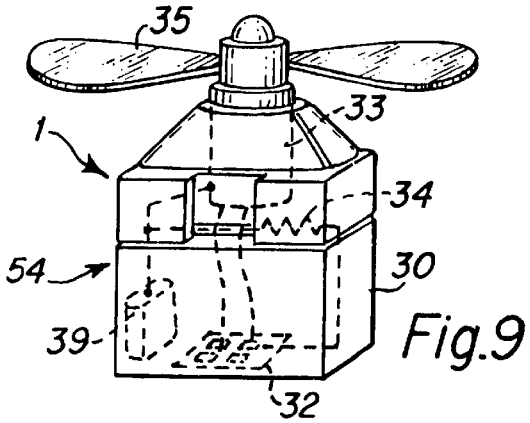
FIG. 9 illustrates a motor driven propeller place piece.

Propeller Block. Play piece 54 is one of the smart blocks, containing a motor driven propeller and is illustrated to larger scale in FIG. 9 to which reference is made. The base 30 of the figure is square in shape. On the underside, that base includes the coupling grips, not visible, which, engage the 2×2 array of studs when installed on the base (or on another block), and, like the dragon figure and troll figure, includes a centrally located male electrical connector of the type previously described in connection with another play piece. An electric DC motor 33 and an identification resistor 34 are encased within the torso. Motor 33 contains a shaft to which propeller 35 is mounted for rotation therewith. A battery 39 is received in a battery compartment within the block to supply power for driving the motor. For practical reasons, those play pieces which include electric motors as requires a heavier current (than LED's) would also possess an internal self-contained battery pack for powering the motor. That power arrangement avoids imposing large power drains on the small size batteries used for the controller.

Figure 10E:
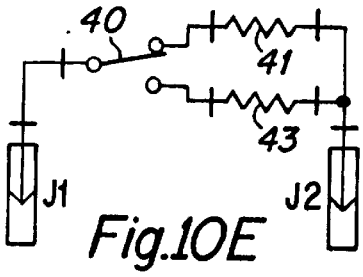
Figure 10C:
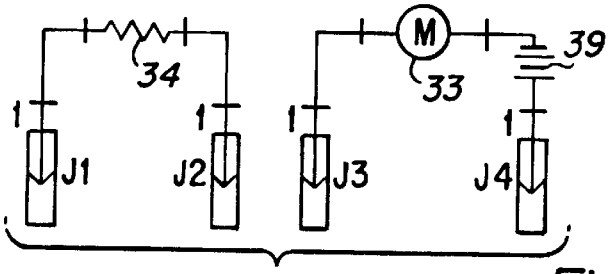

A wiring diagram for this play piece is presented in FIG. 10C. The two electric leads from the motor are wired to two of the contacts J3, J4 of connector 32; and the resistor is connected in circuit across two additional contacts J1, J2 of that connector. When the block is located on a hot spot on the set base 15, the controller is able to "read" the resistance value and identify the smart block and its location on the base. The motor driven propeller is a peripheral device controlled by controller 17. When the controller closes a current path through contacts J3 and J4, the battery current drives motor 33 and, in turn, propeller 35.

The Lamp Block. Referring back to FIG. 1, play piece 3 is referred to as a lamp block. The lamp block contains a light emitting diode 36 and, encased therein, an identification resistor 37, and a current limiting resistor 38 for the lamp. On the underside of the play piece, coupling grips and a male connector of the type previously described in connection with play piece 1 are included, but not illustrated. As is apparent, the mechanical aspects of the play piece are the same as that used in connection with play piece 1, and requires no separate illustration.

Figure 10G:
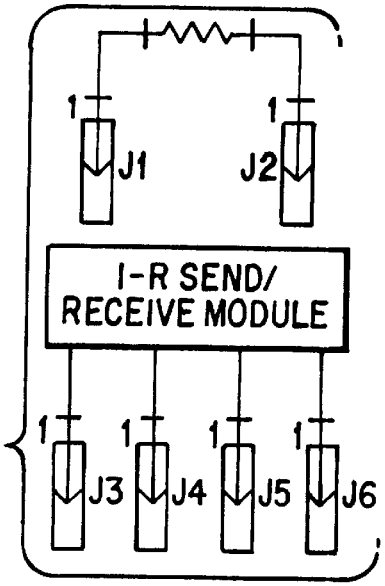
Figure 10D:
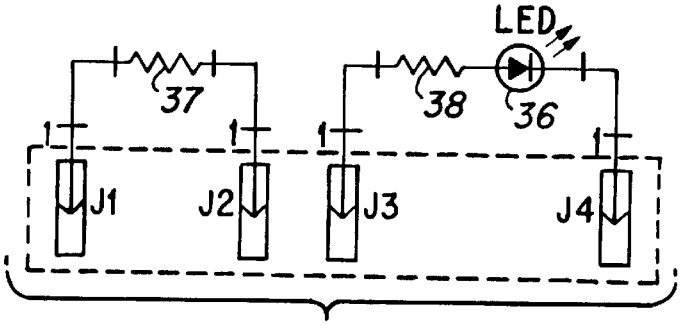

A wiring diagram of the play piece is illustrated in FIG. 10D. As shown, identification resistor 37 is connected between contacts J1 and J2 of the included male connector; and the current limiting resistor and LED are wired in series between contacts J3 and J4 of that connector. The lamp is recognized as a peripheral device controlled by controller 17.

As one realizes, should the Dragon figure block be modified to incorporate LED's in the eye sockets, so that the controller is able to flash the LED's on and off as a special effect, the internal wiring for the Dragon figure would then be like that illustrated for the foregoing lamp block.

The Motor Switch Block. Play piece 5 is a player control input block, more specifically referred to herein as a switch block. The block contains an electrical single pole double throw switch 40, and encases a pair of electrical resistors 41 and 43, identifies the play piece to the controller, and, in addition, identifies the position of switch 40, effectively serving as a controller readable marker. On the underside, but not illustrated, the play piece also includes coupling grips and a male connector of the type previously described in connection with play piece 54. As is apparent, the mechanical aspects of the play piece may be the same as that used in connection with play piece 54, and does not require separate illustration. The switch has three positions to which a player may position the switch, a neutral or off position, with the switch lever vertical, and two separate "on" positions, one with the lever operated in one direction, say to the left, and another with the lever operated in the opposite direction.

A wiring diagram of this play piece is FIG. 10E. As illustrated the pole terminal of the switch is electrically connected to a terminal J1 of the male connector. One end of each of resistors 41 and 43 are connected electrically to terminal J2 of the connector, and the remaining end of each resistor is respectively connected to the two switch poles. Contacts J3, and J4, not illustrated, of the male connector of the play piece remain unused, and hence are not shown in the wiring diagram. The motor switch block permits player input to be made to controller 17.

Figure 10F:
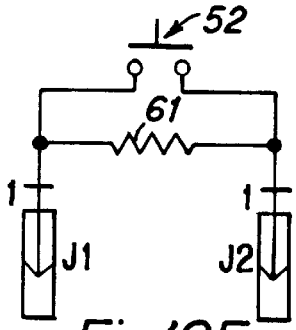

Momentary Switch block. Another block or control input block for providing player inputs to the controller is smart block 52, which contains a momentary operate switch. The block is of a 1×1 size and contains the frictional coupler on the underside to permit mounting to the studs on the set base 15. This block too is a smart block. As in the other smart blocks a four-prong male connector is located on the underside of the block for coupling to a mating connector in the hot spot of base 15. And the block houses inside a unique resistor 61 that is wired between the J1 and J2 of the respective male electrical connector on the underside of the block, not visible in the figure but schematically illustrated in FIG. 10F.

When the momentary switch is pushed, the switch contacts close a short circuit for current to bypass resistor 61. The controller recognizes the lowering of resistance as a switch closure, and responds in the manner called for by the program of the controller, as example, by supplying current to operate the lamp 36 in lamp block 3. When the player releases the switch, the momentary switch automatically opens, restoring resistor 61 in circuit. And, as further example, the controller program may leave the lamp on, until the momentary switch is operated a second time.

Display block. Returning to FIG. 1, display block 53 contains a liquid crystal display ("LCD"). The display is mounted to or is integral with a base portion 56 on which the LCD is vertically positioned. On the underside the base contains a 2×2 matrix of coupling grips, not visible, and the cluster of four male electrical connectors, such as was illustrated in FIG. 6B for block 11. The block is also a smart play piece, that is, an identification resistor, not visible, is included internally in the base and is wired in series with two of the male contacts, J1 & J2, of the connector, such as illustrated in the wiring diagram of FIG. 13. Thus when mounted over one of the hot spots on base 15, the controller recognizes and identifies the display play piece. As in the other smart blocks, the value of the resistance is a unique one that is assigned by the set designer.

The electronic inputs, not illustrated, for producing an image on the LCD are coupled to a display or serial output of the controller by cable 57. The controller 17 contains the conventional driver circuits for the display so that the display produces the image specified by the controller. Preferably the cable is a coil type and is great enough in length to permit the display to be positioned at any location on base 15. Although it is possible to eliminate the cable in more complex embodiments, doing so would require additional connectors to be placed on the base, and does not appear to be practical.

Infra-red transceiver block. An additional smart block 55 contains a miniature wireless transceiver, such as an infra-red or RF transceiver, including battery supplied power. The base 58 of the block is also a 2×2 sized and contains the frictional grips, as earlier described for the other blocks, for mounting the block to the base, but not visible in the figure. The block also includes the unique identification resistor and the male connector to couple the connector to a hot spot when mounted at certain locations on base 15. The wiring for such a play piece may be as illustrated at the lower right side of FIG. 11, in which resistor 60 is shown wired between contacts J1 & J2 of the respective male connector. Such a communication block may be used to transfer information electronically between the present construction set and another construction set similarly equipped with wireless communication.

Due to the nature of the wireless transceiver, a separate cable 59 is used to couple the inputs and outputs J1, J2 (FIG. 10G) and power connections J5, J6 for the transceiver, respectively, to a serial output port of the controller and to the power supply. The microprocessor of the controller is one that contains the appropriate inputs and outputs for communicating with the transceiver and the programming to determine when and what kind of information to send, and for receiving and handling received information transmitted to the construction set.

Wireless transceiver 55 permits the construction set controller to issue control signals to accessories that may be used off site, that is, off of the base 15. Such accessories may be included as an option for later purchase to enhance play and add greater excitement for the child. As example, one such accessory is a radio controlled vehicle play piece 70 illustrated in FIGS. 11 and 12, later herein discussed in greater detail.

Returning again to FIGS. 1 & 2, during set operation, with power switch 21 (FIG. 2) closed and battery power applied to the controller, the player may pick and choose the play pieces to mount on the board. Some standard blocks may be selected and used to build a wall, as an example. The player may also place any of the play pieces illustrated in FIG. 1 at any location on the board. Should the player wish to activate the "imagination" of the controller, however, the player may assemble the pedestal formed of blocks 9, 11, and 13, mount the dragon FIG. 7 onto the pedestal and then mount the pedestal to the board so that the connector on the underside of block 13 mates with one of the connectors, A1–A3 as example, a hot spot in base 15.

As a consequence, resistor 10 in the dragon figure electrically connects through to an input of controller 17, and the controller "knows" that the dragon figure is present. The controller also knows that the dragon figure is located at connector A2, because of the separate inputs used for each base connector location. With that identification information, the controller may select one of the speech or sound messages in its memory, and play it through speaker 23. As example, the speaker may broadcast a sound effect and statement: "WhaaaaWoop", "Dragon entering Castle". The dragon may appear to issue a threatening sound, "pffft, pffft, kabom, pffft".

In further activity, the player may mount the lamp block 3 on the board so that the underlying male electrical connector of the block mates with a base connector, connector A1, as an example; and mount the momentary switch block 52 to another location on the board in electrical engagement with another base connector, connector C2, as an example, whereby each of the two smart blocks is electrically coupled to respective inputs and outputs of the controller 17. Due to the identification information supplied by resistor 37 in the lamp block, and due to the identification information supplied from the resistor 61 in the switch block, controller 17 "knows" the location of the respective lamp block, the location of the switch block and that the switch of the switch block was operated a first time. By pressing the switch, the value of resistance inputted to the controller is changed, say, to the operate position, and the controller recognizes that LED lamp 36 of the lamp block is to be illuminated. The controller then supplies control current over the control circuit output for the location at which the lamp unit is located, which the circuit loop through contacts A1:3 and A1:4 of connector A1, lighting the LED lamp.

The controller may also select and play a speech message or sound effect from a stored library of speech messages, as example: "Warning, warning, the dragon is going to attack" and play a siren sound effect: "whoop, whoop, whoop". By operating the momentary switch of switch block 52 a second time, controller 17 "knows" to terminate the control current, extinguishing the LED lamp, and also, if programmed to do so, halt the sound effects.

If instead of the lamp unit, the player installs the propeller block 54 at a selected location over a vacant hot spot, controller 17 knows that the smart block is installed, and the location of that block on the set base. When the motor switch block 5 is placed on a hot spot in a selected location on the base and the player operates the switch in the motor switch block 5, the controller, in accordance with the application program stored in the controller, may supply current to the motor of propeller block 54. The motor operates and rotates the shaft in the direction of the position of the switch lever. The propeller is attached to and is driven by the motor shaft. Concurrently, the controller may broadcast a speech message through speaker 23 (FIG. 2), as example: "Windstorm Activated! Accelerate wind force to tornado level." When the player reverses the switch position, the controller may reverse the current supplied to the motor in the block, reversing the rotation of the propeller, and the controller may exhibit different sounds and effects. When the player wishes the propeller to stop, the player moves the switch lever to the center position.

In the preferred embodiment, controller 17 may also display cues visually upon liquid crystal display 53 as a supplement or as an alternative to the verbal cues, or may cause the LCD to reveal (display) a "virtual" (invisible) enemy or force as impending danger to stimulate play.

Beyond the specific examples of action and possible effect thus given, the controller preferably is programmed to personalize the figures of the construction set, and effectively create a virtual being for the player. As used herein, the term "virtual being" is recognized as meaning those verbalizations, such as statements and dialog of a living person or creature that allow others, here the player, to perceive that the person or creature has intelligence and a personality, which are actually stored within the memory and program of the computer, electronic controller 17. It also includes inanimate objects to which one wishes to treat as a living person or creature and have come alive, allowing the inanimate object to possess intelligence and personas and to speak and engage others in dialog.

The program creates an artificial person. In effect the person or, more accurately, the "being" exists only in the controller's computer, constituting a "virtual being" that possesses "virtual intelligence" and a "virtual personality". The virtual being is a virtual imitation of a living being with smarts and a personality. That is, a creature will have individual intelligence, experience, wants, needs, requests, and a manner of expressing those that may convey aggressiveness, love, demanding, sympathy, understanding or any of the other human emotions, and a somewhat unique voice. That personality is conveyed to others through speech, sounds and non-verbal actions. If such is attributed to an inanimate object, such as a rocket ship or car, the object is effectively brought to life as a fantasy.

Within the limitations of reasonable quantity of semiconductor memory, a great number or all of such needs and the like, emotions, and the like may be stored within the memory of a digital computer, and then displayed or broadcast from a digital computer, as example, verbally, through the computer's loudspeaker in a way or order designated by the software program. The software program installed within the computer's memory is initially written by one or more persons whose goal is to provide the best possible simulation of the character or characters being visualized and authored by the play pattern or game designer. The program creates an artificial person. In effect the person or, more accurately, the "being" exists only in the controller's computer, constituting a "virtual being". Many such virtual beings can be stored within the memory of a single computer.

Through the controller's programmed reaction to external stimuli and the pronouncements it verbalizes or speaks, an illusion is created of a real living being, particularly when the virtual person is visible to the player in the form of the toy character. The greater amount of available semiconductor memory, the greater amount of content that may be stored to characterize the virtual character, and, thus, the more effective the illusion created. Like the characters in a stage play, the credibility and realism of the illusion depends on the effectiveness of the author in devising a script that defines the characters. Even more life-like than a stage play, the controller is able to interactively involve the player in a scene, which a motion picture or stage play cannot do.

Accessory Vehicle. Earlier reference was made to the incorporation of (and interaction with) accessory toys that need not be installed on the base, an example of which is an accessory vehicle presented in FIGS. 11 and 12 to which reference is made. The vehicle chassis is in the form of a long block containing coupling studs 71 on the upper surface, four wheels 73 and axles 72 for supporting those wheels to the block that the player may assemble to construct the accessory vehicle. The upper surface contains a "hot spot" electrical connector 79, centered between four of the coupling studs. That connector 79 is the same as that earlier described for the hot spots in the base, described in connection with FIG. 3. Other special blocks and/or character figures, earlier described, may be mounted to the vehicle.

Figure 12:
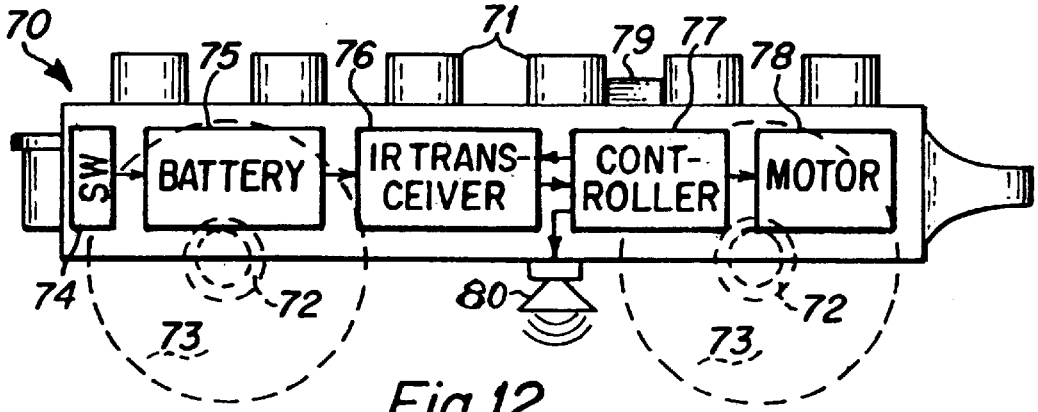
Figure 14:
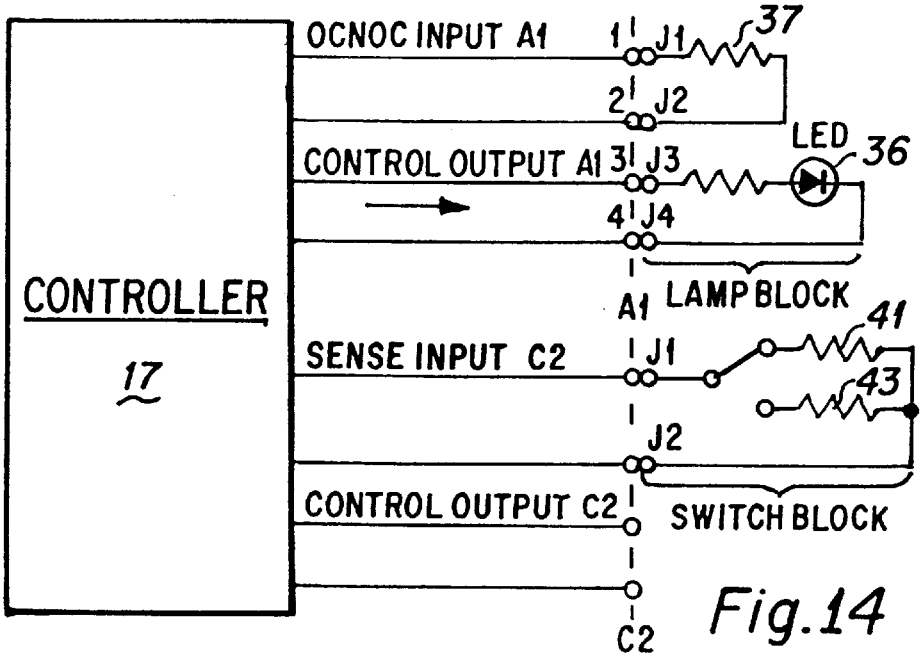
FIG. 14 is a diagram of the circuits established between the controller, lamp block and switch block when the latter blocks are installed on the base, which is used in connection with the description of the operation of the invention.

As illustrated in the block diagram of FIG. 12, a power switch 74, battery 75, IR transceiver 76, controller 77, a motor 78 and a speaker 80, all of conventional structure, which are encased within or supported by the chassis (sic the long block). One of the wheel shafts contains a gear or a gear surface which, when placed onto the vehicle, engages a gear driven by the shaft of motor 78, all of which is known structure and is not illustrated. Controller 77 includes an integrated circuit microprocessor and, in essence, is a smaller capacity version of controller 17 in the basic construction set earlier described. This controller includes the library of identification information necessary to identify any block or character installed over hot spot 79 on the long block. The controller also outputs information for transmission via transceiver 76 to the controller 17 in the construction set base and outputs verbal messages or sound effects through speaker 80. The controller includes inputs to receive information from transceiver 76.

When the vehicle is to be controlled by controller 17 of the construction set, power switch 74, accessible to the player, is operated enabling the receiver and control circuits to receive battery current and power-up. When the controller determines that the vehicle is to move forward, the controller issues a control signal via transceiver 55. Transceiver 76 receives and decodes that signal, and controller 77 processes that signal and actuates motor 78. The foregoing is merely an example, and more complex kinds of electronic control may be introduced as a substitute. When a smart block is installed on the connector 79 in the vehicle, controller 77 identifies the smart block, and holds that information in memory. Controller 77 also contains a code with the identity of the accessory.

In the base of the construction set, controller 17, in addition to checking for smart blocks installed on the base, as was earlier described in connection with FIGS. 1 and 2, is also programmed to check for information received from the transceiver 55 associated with the base. As example, controller 77 will periodically issue a command to each accessory via transceiver 55 to supply information. As received and decoded at the vehicle accessory, the vehicle controller 77 transmits the accessory code together with the code of any smart block as may be installed in the vehicle. Decoded and received at the base unit, controller 17 stores that information in memory for use in connection with the particular game program or play pattern program being processed. As example, the program being processed by controller 17 may call for emission of a speech message from speaker 80 in the vehicle.

In that event controller 17 issues and transmits (via the wireless transceiver 55) a code associated with the vehicle accessory, and the code for the speech message. Received and decode at transceiver 76 in the vehicle, the controller 77 recognizes that the information is intended for the vehicle, deciphers the action code prescribed by controller 17, and from the associated library of speech messages, generates the speech message and broadcasts that message through speaker 80.

Referring again to the embodiment of FIGS. 1 and 2, as a battery saving feature, controller 17 also checks for play activity. Should the player refrain from making any player inputs for a predetermined period of inactivity, the controller places the set in a "sleep mode", minimizing the generation of sounds, lights, speech IR-scanning and the like power consuming functions. As part of that sleep mode it continues to check the block sensors, the hot spots, from time to time to determine if at least one character has been moved, indicating the renewal of play activity, after which it restores full program operation.

Although not illustrated, it should be realized that the construction set includes a quantity of standard blocks of existing design, those which do not contain electrical wiring. Those standard blocks enable the child to build bigger structures, as in the prior construction sets. Thus, in that sense the present invention may be viewed as an enhancement or upgrade to the design of an existing construction set. However, such is a trade-off or compromise between cost and value. The standard blocks cost less to manufacture than the special play pieces. Thus a construction set comprised entirely of the special play pieces would cost much more than one comprising a mixture of the standard and special play pieces, and would not necessarily offer greater play value for the child than a set with an optimized mixture of the two types of blocks. Various blocks may be configured to depict specific types of themes, such as military camps, medieval castles or key elements of major male action entertainment properties such as the Star Wars™ or Batman™ properties.

In alternative embodiments, controller 17 may include an internal electronic clock that keeps track of the time of day, either as an application program function of the processor or with an additional clock chip set. The time of day is initially entered or set on that clock in any conventional manner, once electrical power is supplied to the construction set. In a similar manner to the way in which controller is programmed to keep track of the daily passing of time (i.e., the clock function), the controller, in addition may also be programmed to keep track of the weekly, monthly, and yearly passing of time (i.e., a calendar function), a clock-calendar 50 (FIG. 2).

With a calendar stored in the controller's read only memory (ROM) and appropriate controller programming, the controller is also able to know the day of the week, month, and year. The same means that enables the clock to be set to the present time of day and date, can also be used to permit the player or parent to program into the controller special days, such as birthdays and holidays, and the program of the controller will call out and deliver a message to the player in advance of the special day, thereby adding to the illusion of "intelligence".

Thus when the construction set is powered up and battery (DC) power supplied to controller 17, following initialization, the controller runs its start-up program, requesting that data be entered, which the controller stores the data entered in non-volatile memory, that is, memory which retains the entered data, until power to the environment is turned-off via power switch 21 or battery 19, shown in FIG. 2, fails. In the start-up program, the controller outputs a spoken query to the player, a speech cue prompting the player to scroll right or left, speaking the new hour each time until the player recognizes that the correct hour is attained and presses the enter button is pressed. When that information is entered by pressing the appropriate enter button on the keypad, another spoken cue prompts entry of the minutes, which the player scrolls to the correct minute, which the controller confirms by its spoken recitation, and the player again presses the enter button. The controller continues with prompts for the year, month and day in the same manner and the player responds in the same manner as described. Alternatively, should LCD display block 53 be included in the original purchase, the controller can be programmed to provide a visual display of the time and date. In that alternative a push button switch may be depressed until the digital read-out on the display shows the correct time and date; and a like procedure is used for correctly entering information of special dates or times.

More sophisticated and costly alternative embodiments of the invention may also incorporate a speech recognition integrated circuits to assist a player. This is indicated in FIG. 2, to which reference is again made, by the block labeled speech recognition 49 and the companion microphone block 51, which are drawn in dash lines. As is known speech recognition function may be accomplished with software in the existing controller, which imposes considerable work on and may slow down a processor. Alternatively, the speech recognition function may be accomplished in a separate processor IC whose outputs, the commands interpreted by the speech recognition function, may be supplied to the principal processor of the controller 17. With speech recognition circuits a player is able to issue verbal commands or responses to the controller, and the controller is able to "understand" and act on those commands. The speech recognition function may be programmed to function as a switch on recognizing speech, word recognition or a noise, like a hand clap, whistle or the like. In accordance with the program, the controller may initiate a dialog with the player, and could play games with the player, permit the player to create passwords and secret words, permit the player to recite "magic spells" and incantations and the controller recognizing those, would cause things to happen.

Continuing with FIG. 2, drawing block 45 represents a conventional memory cartridge port for a flash card ROM and/or RAM, which stores additional programs and vocabulary to add to the basic embodiment. The toy manufacturer may create alternative game play and accessory character blocks following manufacture of the construction set and market that new game and accessory character blocks to purchasers of the construction set. The digital information for that game play and character are contained in the flash card. The controller 17 is programmed to check the port for a flash card. Should the controller find a flash card present, it checks the digital information. As example, the controller is able to access character information for use when needed. Where provided for by the manufacturer, the character information may be added to the character information already in the memory of the controller and that character can be integrated into a play pattern existing in the controller, apart from the new game program in the flash card.

Additional flash cards can be used to store additional game programs or play patterns obtained from the manufacturer or others via the internet. One common means to access the internet is by use of the familiar personal computer ("PC"), such as pictorially illustrated in FIG. 2 in dash box 66, which is connected via modem to a telephone line or cable (via an "ISP") to the global network, commonly referred to as the Internet or Cyberspace. The player or other Internet savy person accesses the Internet and locates as an example, using the browser program, such as Internet Explorers® browser, the web-site maintained by the set manufacturer. The manufacturer may provide references to programs which the player may download. Although typically created by the manufacturer, the site may also contain additional programs created by other players (and checked by the manufacturer to ensure there is no profanity or dirty tricks in the program) which have been contributed to the site to make the programs available to other players. Viewing the web site with the browser on PC 66, any available program thereon may be downloaded into the PC, and stored on the hard disk of the PC. After disconnecting from the internet, the flash card may be connected to a suitable port in the PC and a copy of the program files may be transferred from the hard disk into the flash card. The flash card may then be withdrawn from the port of the PC and plugged into the flashcard port 45 (add-on memory) port of controller 17. Conversely, a player or other person skilled in the computer arts may design a program on the PC and upload the program to the particular page provided on the manufacturer's web site for receiving uploads.

EPROM, that may be "plugged" into the controller or in a Flashcard with data downloaded from a PC or web-site of the Internet. The controller is programmed to perform the various tasks and functions such as further described herein The invention provides a way to fit the blocks together in a way that also creates artificial intelligence and virtual life, personas, in the blocks, what is constructed, and the characters that inhabit or have adventures within the construction. Irrespective of the specific configuration the invention provides a means by which an input and an output can be sent to and from a microprocessor/controller that is part of the construction set or from a PC to which the construction set is cabled or with which it interfaces wirelessly, and from various play pieces and characters in the construction set. And those connections, whether they are hard wired into something that is the equivalent of the electrical connections in the base in the specific embodiment illustrated or are wireless as we illustrate with IR or RF, enable the controller, the "brain", to know where each of the play pieces and characters are located within the construction set.

Once this information is conveyed to the controller or PC, the program of the controller determines the appropriate audio information such as speech messages and sound effects to exhibit or display. Visual information, whether on the LCD readout on the LCD (display) block, a lighted lamp or graphics depicted on a PC monitor or TV, allows the characters (figures) of the construction set to become virtually alive and artificially intelligent, and to interact with each other and the child user in a virtually real and intelligent way. The play pieces and construction set may then take on a persona as if it has virtual life. And in a similar way, virtual characters, separate from the character figures, perhaps visible only as a force field wave illustrated on the LCD screen, or footsteps becoming louder and louder as they come closer even though the character is not visible, will be "virtually real" and react and interact with the child in intelligent response to how the child responds to approaching danger.

The invention is able to play games with the player. As example, virtual viruses released by an imaginary enemy can be hidden in particular hot spots of the base, and the LCD and speaker can begin an audio and visual countdown, with the clock of the controller keeping track of the time remaining until the player's base is destroyed and the enemy wins. The player must act to quickly find the hidden virus as by placing a correct smart block on the hot spot on which the virus is hidden. Tension created by these virtually alive devices enable virtual interactive play in the construction category that has never before been experienced as part of construction play. As is apparent, the particular messages and sound effects used may with imagination be combined with the action play of construction, and may include random messages, to provide an attractive game or playset, thereby taking the construction set into another and more interesting realm that provides a more lasting play value for the child player.

It should be appreciated that the structure and programming of the controller used in the foregoing embodiments of the invention is defined in terms of the functions performed, which appear elementary in nature, and, as is understood by those skilled in the art from reading the foregoing description, a practical implementation of the invention may be accomplished with many different alternative configurations and programs. As further recognized by those skilled in the art, from an understanding of the foregoing description, the details of any particular computer program to specifically implement a practical embodiment of the foregoing invention may be readily written by those skilled in the computer and programming arts without undue experimentation.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification.

Thus, other smart blocks may be included with different peripheral devices. As example, another smart block may include a motion detector that senses movement or a change in light and produces a signal input to the controller. The controller responds with a response specified by the program. As example, a siren sound could be exhibited in response. Other effects may be chosen as an alternative.

Further, as is recognized, play pieces may be rectangularly shaped, and may be included in various lengths in addition to the 1×1 square shape of the smallest block. Typically larger size rectangular shaped play pieces may be included in the play set, including 1×2 size which fits over a group of six studs (2×3), and 1×4, which fits over a group of eight studs (1×8). Moreover, although a particular form of electrical connectors were employed in the foregoing embodiment, as those skilled in the art recognize, other alternative electrical connectors may be substituted. Further, the specific embodiment employed the stud and grip coupling for the blocks and base. However, other equivalent forms of block coupling used in products competitive with the stud and grip type construction sets, as example, the stud and coupling socket type, which are equivalent in the foregoing combination may be substituted.

As those skilled in the art realize from the foregoing description, although the foregoing embodiment employs the stud and socket configuration of connectable blocks that is dominant currently, other configurations of connecting blocks may be substituted for those blocks, whether presently existing or that is designed in the future, without departing from the present invention. It does not matter what the system of construction is, or what the configuration of each of the "block" elements is, or how they fit together.

It should also be appreciated that the use of the terms coupling studs or grips is not to be construed in a restrictive sense, but is intended to encompass, include and subsume, pins, sockets, and other forms of mechanical attachment that is readily attached to mount a part in place and may be readily detached by a child when the part is to be removed, all of which come within the scope of the present invention. The invention may be constructed using all the equivalent forms of mechanical coupling structure employed in and/or available, or that may become available for children's construction sets.

One may also recognize that engagement between the mating electrical connectors in the foregoing embodiment may provide a sufficient frictional force that resists detaching one block from another (or from the base) that is in addition to that provided by the coupling pins and grips, although the electrical connectors are not required to do so, and may even be frictionless type connectors. Indeed with some such electrical connectors the friction existing between the mating play pieces (or with the base) may alone be sufficient to hold the play piece in place, as would appear to eliminate the necessity for such coupling studs and grips. However, as those skilled in the art appreciate from an understanding of the foregoing description, the latter is not a meaningful alternative, since such a combination would preclude the use and mounting of the purely mechanical blocks and play pieces as part of the play set and is therefore a less preferred alternative.

Thus the invention is to be broadly construed within the full scope of the appended claims.

What is claimed is:

1. A construction playset, comprising:

a housing having a planar upper surface defining a base, said base including a plurality of at least four coupling pins, said coupling pins being arranged in a plurality of rows and columns and upstanding from said planar upper surface;

said base further including a plurality of multi-terminal electrical connectors defining base electrical connectors, said base electrical connectors being accessible from said surface of said base;

each of said plurality of base electrical connectors being symmetrically centrally positioned between a respective two of said coupling pins in one row of coupling pins and a respective two adjacent pins in an adjacent row of said coupling pins, whereby said base electrical connectors are distributed at different locations on said base;

a first plurality of play pieces, said first plurality of play pieces including:

top and underside surfaces, said top surfaces of said play pieces containing a plurality of coupling pins, said coupling pins being arranged in rows and columns and extending upwardly, and said underside surface containing a plurality of coupling grips;

said coupling pins for frictionally engaging coupling grips of another play piece and said coupling grips for frictionally engaging coupling pins of another play piece or of said base to temporarily attach a play piece to said another play piece or said base;

each of said play pieces of said first plurality of play pieces further including:

a pair of multi-terminal electrical connectors, said pair of multi-terminal electrical connectors including:

a first electrical connector comprising a multi-terminal electrical plug, said electric plug being accessible from one of said top and underside surfaces of said play piece; and a second connector comprising a multi-terminal electrical socket, said electrical socket being accessible from the other one of said upper and under surfaces of said play piece;

said terminals of said electrical plug being electrically connected to corresponding terminals of said electrical socket to provide a multiple lead electrical extension through said play piece;

a second plurality of play pieces, said second plurality of play pieces having top and underside surfaces, said underside surface containing a plurality of coupling grips, said coupling grips for frictionally engaging coupling pins of another play piece or of said base to temporarily attach a respective play piece to said another play piece or said base;

each of said play pieces of said second plurality of play pieces further including:

a multi-terminal electrical connector for mating engagement with an electrical connector on another play piece or on said base, said electrical connector being accessible from an underside of said respective play piece, said electrical connector comprising either an electric socket or an electric plug in dependence upon whether said accessible electrical connector on the upper surface of said play pieces of said first plurality of play pieces and on said base comprises, respectively, an electric plug or an electric socket, whereby said respective electric socket or electric plug of said play pieces of said second plurality of play pieces may mate with said electric plugs or electric socket of said base or of said first plurality of play pieces.

2. The construction playset as defined in claim 1, further comprising:

a microprocessor based controller, said controller including:

inputs for receiving electrical information and outputs for supplying electrical current, said controller being located within said housing;

wiring means for electrically coupling each of said base electrical connectors to said controller, said wiring means including at least one lead for supplying electrical information to an input of said controller, and at least one lead for coupling output current from an output of said controller.

3. The construction playset as defined in claim 2, wherein each play piece of said second plurality of play pieces further includes:

electrical resistance means for producing an electrical resistance, said electrical resistance means having a resistance value unique to an associated play piece, whereby each play piece contains a unique resistance value to enable identification of the play piece; and said electrical resistance means being connected between two terminals of said multi-terminal connector.

4. The construction playset as defined in claim 3, wherein at least one of said play pieces of said second plurality of play pieces comprises: a toy character.

5. The construction playset as defined in claim 3, wherein at least one of said play pieces of said second plurality of play pieces defines a player input device and includes an electrical switch, said electrical switch being connected in circuit between two additional terminals of said multi-terminal connector of the respective play piece.

6. The construction playset as defined in claim 5, wherein at least one of said play pieces of said second plurality of play pieces includes: an electric motor to define a motorized play piece, said motor having a shaft, said electric motor being connected in a circuit between two additional terminals of said multi-terminal connector of the respective motorized play piece.

7. The construction playset as defined in claim 5, wherein said motorized play piece further includes: a mechanical indicator for indicating rotation of said motor, said mechanical indicator being connected to said motor shaft.

8. The construction playset as defined in claim 7, wherein mechanical indicator is decorated to define a propeller, whereby said propeller turns in response to operation of said electric motor.

9. The construction playset as defined in claim 8, wherein at least one of said second plurality of play pieces includes: a lamp for defining an illuminating play piece, said lamp being connected in a circuit between two additional terminals of said multi-terminal connector of the respective illuminating play piece.

10. The construction playset as defined in claim 9, wherein said microprocessor based controller includes:

means for determining the electrical resistance value presented at an input;

means for determining from an electrical resistance value the identification of a play piece associated with a resistance means of a particular resistance value when said play piece is attached to said base and the connector of said play piece is mated to one of said plurality of connectors in said base, whereby each play piece connected to said base with the connector of said play piece mated to one of said plurality of connectors in said base is identified by the controller; and means for determining the location of each play piece attached to said base with the connector of such play pieces being mated to one of said plurality of connectors in said base.

11. The construction playset as defined in claim 10, wherein said microprocessor based controller further includes:

means for detecting whether said manually operated switch of said switch play piece is in said first or second position when said switch play piece is attached to said base and the connector of said play piece is mated to one of said plurality of connectors in said base;

means, responsive to said switch being in said second position, for outputting current to said illuminating play piece to light said lamp, if said illuminating play piece is attached to said base and the connector of said illuminating play piece is mated to one of said plurality of connectors in said base.

12. The construction playset as defined in claim 9, wherein said microprocessor based controller further includes:

means, responsive to detection of each operation of said momentary operate switch of said switch play piece when said switch play piece is attached to said base and the connector of said play piece is mated to one of said plurality of connectors in said base, for alternately supplying current to said lamp via said wiring means and mating connectors of said base and said illuminating play piece, and extinguishing said current, when said illuminating play piece is attached to said base and the connector of said illuminated play piece is mated to one of said plurality of connectors in said base, whereby said lamp alternately illuminates and darkens.

13. The construction playset as defined in claim 7, wherein said microprocessor further includes:

means, responsive alternate operation of said momentary operate switch of said switch play piece when said switch play piece is attached to said base and the connector of said play piece is mated to one of said plurality of connectors in said base for alternately supplying and terminating driving current to said motor via said wiring means and mating connectors of said base and said motorized play piece, whereby said motor alternately turns said motor shaft and stops turning said motor shaft.

14. A child's construction and play set comprising:

a base;

a set of blocks, each of said blocks in said set including electrical wiring; wherein a play setting may be constructed on said base from at least some of said blocks of said set; and a controller, said controller including a program, said program for identifying and determining the location on said base of any of said blocks of said set.

15. A child's construction and play set comprising:

a base;

a set of blocks, said blocks including player operated control input blocks and electrically operated peripheral device blocks; wherein a play setting may be constructed on said base from at least some of said blocks; and a controller, said controller including a program, said program for identifying and determining the location on said base of any of said peripheral device blocks and said control input blocks.

16. The child's construction and play set as defined in claim 15, wherein said program is also for controlling operation of said peripheral device blocks, and for determining player operation of a control input block and providing response to said player input of said player operated control input blocks.

17. The child's construction and play set as defined in claim 15, wherein said blocks further include at least one character figure; wherein said controller includes a speaker; and wherein said program of said controller includes personas for character figures, said personas being defined by speech messages and/or sound effects and for selecting said speech messages and or sound effects for delivery through said speaker to exhibit a persona to a player.

18. The child's construction and play set as defined in claim 15, wherein said controller includes a speaker; and wherein said program of said controller includes a persona for at least one of said blocks, said persona being defined by speech messages and/or sound effects and for selecting said speech messages and or sound effects for broadcast through said speaker to exhibit a persona to a player.

19. The child's construction and play set as defined in claim 18, wherein said program includes means for selecting a speech message for broadcast in response to player operation of one of said control input blocks.

20. The child's construction and play set as defined in claim 19, wherein said program further includes means for selecting a speech message for broadcast in response to player application of a block to said base.

21. The child's construction and play set as defined in claim 16 further comprising: wireless transceiver means for respectively transmitting and receiving digital information wirelessly to and from a remote wireless transceiver; and wherein said controller checks said transceiver means for received digital information and supplies digital information to said transceiver means for transmission to said remote wireless receiver.

22. The child's construction and play set as defined in claim 16 further comprising: means for accessing the Internet, said means being associated with said controller.

23. In combination with the child's construction and play set as defined in claim 21, further comprising: an accessory block; a battery power supply, a speaker, a wireless transceiver and an accessory controller supported by said accessory block; said accessory controller for identifying any peripheral device block supported on said accessory block and for transmitting said identification information via said wireless transceiver to said wireless transceiver of said construction set.

24. A child's interactive construction and play set comprising:

a set of blocks and a base;

said set of blocks including:

a plurality of smart blocks, each said smart block including a computer readable identification marker identifying the respective block and an electrical coupler to provide computer access to said identification marker by a computer external to said block;

said plurality of smart blocks including:

a plurality of control signal blocks, each said control signal block including means for receiving a player input; and a plurality of peripheral device blocks, each said peripheral device block for performing an electrically motivated function when actuated; and a plurality of character figures;

said base providing a surface on which to apply said blocks to construct a play setting, said play setting including structures formed by and things represented by said set of blocks;

said base including a plurality of hot spots to couple to electrical couplers of said smart blocks, said hot spots being distributed at predefined locations about said base;

a programmed controller, said programmed controller including a program;

said programmed controller including a plurality of sense inputs coupled to respective ones of said hot spots for reading the identification of smart blocks that are disposed on said base overlying respective hot spots in which the respective electrical coupler of a respective smart block is electrically coupled to a respective hot spot and for determining the location of each of said respective smart blocks on said base overlying one of said hot spots and in respect of any of said electrically coupled smart blocks that comprise a control signal block for also reading any player input at said control signal blocks, whereby said controller has identification and location information for said smart blocks and player input information for any player inputs at those smart blocks which comprise a control signal block;

said programmed controller further including a plurality of control outputs coupled to respective ones of said hot spots for applying a control current to a peripheral device block selected by said program in response to a player input to one of said control signal blocks when the electrical coupler of said selected peripheral device block overlies a hot spot on said base and said electrical coupler of said control signal block overlies another hot spot on said base.

25. The child's interactive construction and play set defined in claim 24, wherein said set of blocks further includes:

a plurality of electrical inter-connection blocks, said electrical interconnection blocks for extending electrical connections between one location on one of the top and bottom sides thereof to a second location on the other of said top and bottom sides;

each of said interconnection blocks including a hot spot on one side for coupling to the electrical coupler of a smart block and an electrical coupler on an opposed side for coupling to a hot spot on said base or to a hot spot on another interconnection block, whereby the position of a hot spot on said base is effectively emulated at a position elevated from said base.

26. The child's interactive construction and play set defined in claim 24, wherein said programmed controller further includes: a speaker; and means for generating speech messages and sound effects selected by and when required by said program and broadcasting said speech messages and sound effects through said speaker.

27. The child's interactive construction and play set as defined in claim 26, wherein said programmed controller further includes:

a virtual persona for each of said character figures, said virtual persona comprising a plurality of speech messages and sound effects for simulating knowledge and intelligence inherent in a living being, whereby the respective character figure possesses a virtual life.

28. The child's interactive construction and play set as defined in claim 27, wherein said controller further includes a game, said game involving at least one of said virtual character and peripheral device blocks.

29. The child's interactive construction and play set as defined in claim 28, wherein at least one of said peripheral device blocks comprise an LCD display.

30. The child's interactive construction and play set as defined in claim 28, wherein at least one of said peripheral device blocks comprise an electric motor.

31. The child's interactive construction and play set as defined in claim 30, wherein at least one of said peripheral device blocks comprise an LED.

32. The child's interactive construction and play set as defined in claim 31, wherein at least one of said peripheral device blocks comprise a wireless transceiver.

33. The child's interactive construction and play set as defined in claim 24, wherein said programmed controller further includes: an electronic clock calendar.

34. The child's interactive construction and play set as defined in claim 24, further comprising: wireless transceiver means for respectively transmitting and receiving digital information wirelessly to and from a remote wireless transceiver; and wherein said programmed controller checks said transceiver means for received digital information and supplies digital information to said transceiver means for transmission to said remote wireless receiver.

35. The child's construction and play set as defined in claim 24, further comprising: Internet access means for accessing the Internet, said Internet access means being associated with said programmed controller.

36. In combination with the child's construction and play set as defined in claim 24, further comprising: an accessory block, said accessory block including a hot spot; a battery power supply, a speaker, a wireless transceiver and an accessory controller supported by said accessory block; said accessory controller for identifying any smart block supported on said accessory block in a position overlying said hot spot and for transmitting said identification information via said wireless transceiver to said wireless transceiver of said construction set.

* * * * *